US005286136A

United States Patent [19]

Mandish et al.

[11] Patent Number: 5,286,136

[45] Date of Patent: Feb. 15, 1994

[54] HIGHWAY BARRIER APPARATUS AND METHOD

[76] Inventors: Theodore O. Mandish; Doneath M. Mandish, both of 5055 State Rd. 46, Mims, Fla. 32754

[21] Appl. No.: 712,966

[22] Filed: Jun. 10, 1991

[51] Int. Cl.[5] ..... E01F 13/00

[52] U.S. Cl. ..... 404/6

[58] Field of Search ..... 404/6; 106/97; 264/20-23, 110-118; 524/5-8; 256/13.1, 1

[56] References Cited

U.S. PATENT DOCUMENTS

| | | | |
|---|---|---|---|
| 3,899,455 | 8/1975 | Unterstenhoefer | 524/66 X |
| 4,011,355 | 3/1977 | Mandish et al. | 524/8 X |
| 4,665,673 | 5/1987 | Diana | 404/6 X |
| 4,816,503 | 3/1989 | Cunningham et al. | 524/514 X |
| 4,844,652 | 7/1989 | Schroughan | 404/6 |
| 4,854,767 | 8/1989 | Sasaki | 404/6 |
| 4,906,298 | 3/1990 | Natsuume et al. | 106/97 |
| 4,964,750 | 10/1990 | House et al. | 404/6 |
| 5,022,782 | 6/1991 | Gertz et al. | 404/6 |
| 5,074,705 | 12/1991 | Schmitt | 404/6 |
| 5,108,668 | 4/1992 | Kallup | 264/23 |
| 5,108,679 | 4/1992 | Rirsch et al. | 264/118 |

*Primary Examiner*—James R. Brittain
*Assistant Examiner*—Nancy P. Connolly
*Attorney, Agent, or Firm*—William M. Hobby, III

[57] ABSTRACT

An energy absorbing roadway barrier for dissipating kinetic energy upon impact by a moving vehicle includes an elongated core of reinforced high density concrete having barrier anchor members attached from the elongated core to a position for anchoring the barrier. An elongated barrier portion is formed around the elongated core and around the core anchor members to form a road barrier. The barrier portion is formed of lightweight concrete using lightweight resilient polymer pieces formed in a cement and water mixture and an interlock portion is formed on each end of the road barrier to connect road barrier sections. The lightweight concrete may be pieces of chopped up vulcanized rubber, such as chopped up used tires which have been prepared and coated and mixed with a cement mixture, alternatively lightweight polymer such as polystyrene, which may be chopped up used polystyrene being recycled can be incorporated into the barrier portion.

9 Claims, 1 Drawing Sheet

HIGHWAY BARRIER APPARATUS AND METHOD

BACKGROUND OF THE INVENTION

The present invention relates to an energy absorbing roadway barrier for dissipating kinetic energy upon impact by a moving vehicle and a method of making the energy absorbing roadway barrier.

Media barriers are often disposed between opposing lanes of traffic on a divided highway to prevent head-on collisions. A common form of such media barrier are formed of precast or poured concrete structures somewhat bell-shaped in cross section and having a wide bottom to resist tipping from impact with an automobile or other vehicle and a flared lower section to engage the tire of a vehicle veering from the road into the barrier and a more or less vertical upper section rising to a flattened barrier top. The flared lower section allows the vertical upper section to be set back far enough to provide clearance for the body of the vehicle. Thus, if a vehicle veers into the barrier at a small angle, the barrier acts to turn the car back onto the roadway to prevent a possible head-on collision with vehicles in the lanes of opposing traffic.

Energy absorbing barriers have also been used for vehicular traffic applications including those of a semi-permanent nature which are heavy and difficult to install and can be expensive to maintain. Barriers of this type include fixed guardrails, concrete median barriers, and special structures located in a protected array around highway signs, bridge abutments, and the like. The lighter more portable barriers are less likely to absorb as much impact energy but they are more easily installed for defining temporary traffic lanes, closing off highway construction sites and establishing pedestrian walkways. Typical highway barriers comprise elongated blocks of concrete arranged end-to-end to intercept vehicles leaving a defined traffic lane which have special shapes to direct the tire hitting the barrier and consequently the vehicle away from crossing the barrier regardless of the shape of the construction. Most barriers are made non-resilient, massive, and heavy in order to possibly stop vehicles. This then becomes more dangerous to the vehicle and to the occupants so that some barriers have been designed to progressively absorb kinetic energy and thereby gradually decelerate a vehicle. Energy absorbing barriers have been suggested having internal chambers filled with gas, liquids, or other fluent materials and sometimes containers, such as barrels filled with sand, while others have depended upon springs or internal shock absorbers. Most of these prior energy absorbing barriers are not readily adapted for interconnection to define a vehicle lane and are characterized by sidewalls undesirably shaped for redirecting the direction of the vehicle tire running onto the barrier or to allow the vehicle tire to climb a portion of the barrier and be re-directed from the barrier.

Typical prior art barriers can be seen in the Zucker U.S. patent for a roadway barrier and restraining cap combination, U.S. Pat. No. 4,502,812, and in the Thompson patent for an energy absorbing barrier, U.S. Pat. No. 4,681,302. The Almer et al. U.S. Pat. No. 4,661,010, is for a concrete block designed to serve as a roadway barrier while the Slaw, Sr. U.S. Pat. No. 4,605,336, is a joint construction of concrete members for joining barrier-type members end-to-end. The Hahne, U.S. Pat. No. 4,641,993, is a highway barrier with level internal ducts and a construction method. The Younker, U.S. Pat. No. 3,678,815, is a concrete structural member and a method of forming the same. The Stewart, U.S. Pat. No. 817,282, is a composition fence post having a barrier-like shape while the Chiodo, U.S. Pat. No. 4,869,617, is a portable highway barrier which can be filled with water or other fluid. The Fitch, U.S. Pat. No. 3,643,924, is a highway safety device for deflecting or decelerating a vehicle. The Gertz et al., U.S. Pat. No. 4,352,484, is a shear action and compression energy absorber for dissipating the energy of the impact of a vehicle while the Forster et al., U.S. Pat. No. 4,435,106, is a roadway barrier for directing the wheels of a vehicle impacting the barrier and has a steep convex rise portion. The Diana, U.S. Pat. No. 4,665,673, is a monolithic surface ornamentation of precast reinforced concrete wall which includes barrier designs while the Duckett, U.S. Pat. No. 4,806,044, is an anti-crash lane barrier with a self-centering hinge.

Applicant's prior patents dealing with lightweight concrete construction or components can be seen in U.S. Pat. No. 4,011,355 for a lightweight composition and method using coated polystyrene beads in a concrete mixture to make a lightweight concrete and in the U.S. Pat. No. 4,355,484 for a hydroponic tray or method of manufacture which provides for a floating hydroponic system using lightweight concrete and in U.S. Pat. No. 4,468,885 for a hydroponic system with floating plant trays and precast concrete sidewalls. The method for making the material is derived from Applicant's prior U.S. Pat. No. 4,011,355. The present improved process is especially adapted for use in the recycling of materials, such as chopped up rubber tires and chopped up used polystyrene which thus serves the purpose of reinforcements and strengthening lightweight barrier members while recycling used materials which are otherwise difficult to recycle and providing an energy absorbing barrier portion supported by a high density reinforced core anchored with steel anchors.

SUMMARY OF THE INVENTION

An energy absorbing roadway barrier for dissipating kinetic energy upon impact by a moving vehicle includes an elongated core of reinforced high density concrete having barrier anchor members attached from the elongated core to a position for anchoring the barrier. An elongated barrier portion is formed around the elongated core and around the core anchor members to form a road barrier. The barrier portion is formed of lightweight concrete using lightweight resilient polymer pieces formed in a cement and water mixture. An interlock portion is formed on each end of the road barrier to interconnect road barrier sections. The lightweight concrete may be pieces of chopped up vulcanized rubber, such as chopped up used tires, which have been prepared and coated and mixed with a cement mixture. Alternatively lightweight polymer, such as polystyrene, which may be chopped up used polystyrene being recycled, and is incorporated into the barrier portion. Treatment of the lightweight polymer pieces can include mixing the pieces with fiberglass and microsilica and with an acrylic and rock as desired prior to the mixing in the cement and water composition. A process of making an energy absorbing roadway barrier for dissipating kinetic energy upon impact by a moving vehicle includes the steps of forming an elongated core of reinforced high density concrete, then attaching a plurality of elongated core supports and barrier anchor members to the core, then mixing a plurality of lightweight polymer pieces, such as chopped up rubber tire pieces or chopped or preformed polystyrene pieces, with fiberglass, microsilica, sand, and portland cement and water, then forming the mixture in an elongated barrier mold of a predetermined shape around the elongated core and around each elongated core support anchor member and curing the mixture to form the road barrier.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
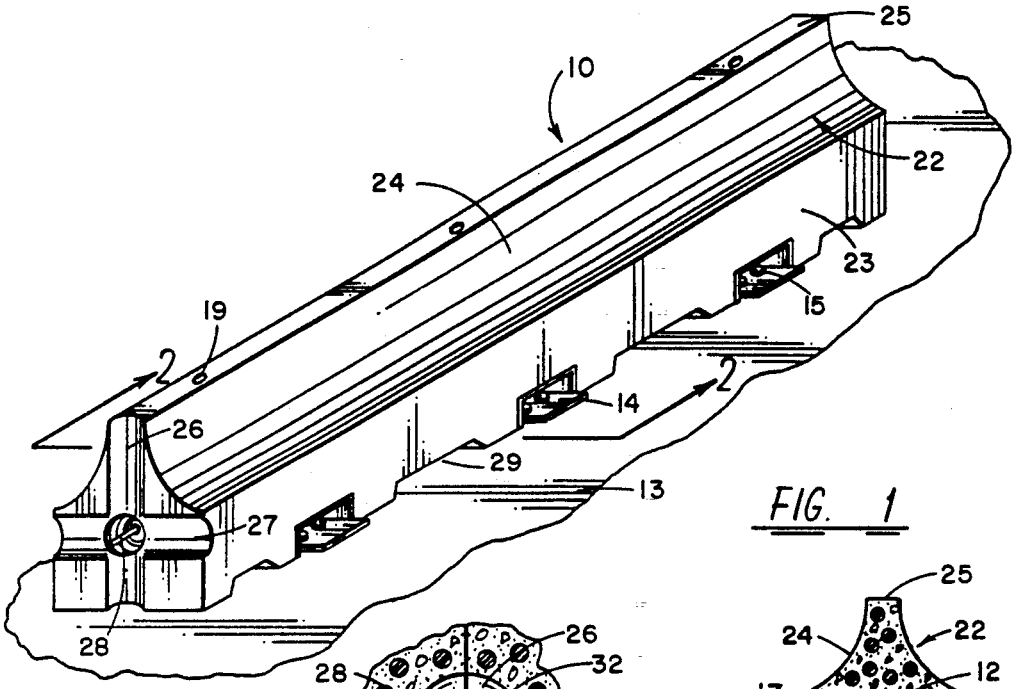
FIG. 1 is a perspective view of a road barrier section in accordance with the present invention anchored to a surface.
Figure 2:
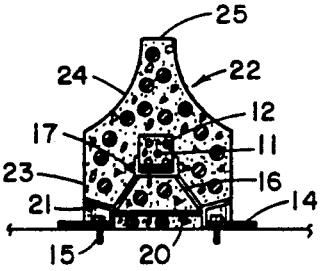
FIG. 2 is a sectional view taken on the line 2—2 of FIG. 1.

Referring to the drawings and especially to FIGS. 1 and 2, anti-crash type road barrier 10 is an energy absorbing roadway barrier for dissipating kinetic energy upon impact by a moving vehicle tire and includes a central core of high density concrete having a plurality of prestressed reinforcing steel rebar members 12 passing therethrough. The roadway barrier 10 is mounted to a roadway 13 with barrier anchors 14 bolted with anchor members 15 to the roadway 13. The roadway anchor portion 14 can be seen connected with steel extensions 16 to a generally U-shaped support channel member 17 which in turn is attached to the core member 11 with fasteners or bolts 18. In addition, the support and anchor members has a cross-brace member portion 20 and a cover portion 21 formed over the anchoring base 14. The entire road barrier 10 core 11 has a lightweight concrete material 22 formed thereover and designed to be an energy absorbing and sound absorbing lightweight concrete for dissipating kinetic energy upon impact with a moving vehicle or the like. The roadway barrier 10 is shaped to have a flat bottom portion with a vertical rise portion 23 and a pair of arcuate portions 24 on either side thereof capped with a narrow flat ridge 25 having a plurality of openings 19 therein for placing inserts for lifting the barrier. A raised portion 29 forms a passageway for water to pass beneath the barrier. The end of each barrier member 10 has a keyway 26 extending vertically while a half-circle access reveal 27 matches the half-circle on adjacent or abutting barrier member to provide an access from the side at the adjoining joint between two members while the interlock keyway 26 can provide access from the top. A central rebar member 28 from the high density concrete core 11 can protrude from the end for attaching to the next abutting barrier member 10. The central rebar member 28 does not have to be prestressed.

Figure 5:
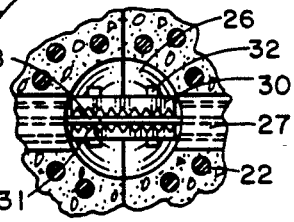
FIG. 5 is a sectional view on an enlarged scale of the connection between barriers.
Figure 3:
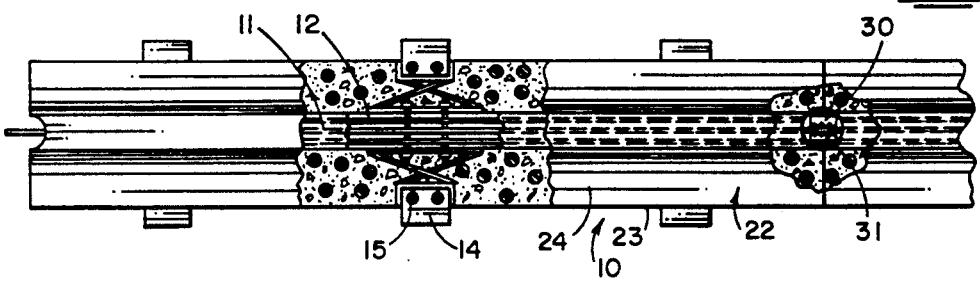
FIG. 3 is a cutaway top elevation of the road barrier of FIG. 1 showing the connection between road barriers.
Figure 4:
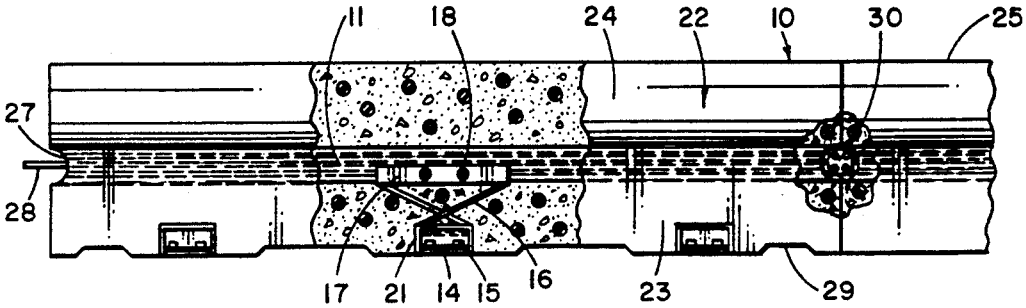
FIG. 4 is a cutaway side elevation of the road barrier connection and anchors of a road barrier in accordance with FIG. 3.

As more clearly seen in FIGS. 3, 4, and 5, the barrier members can be attached with a pair of clamping members 30 and 31 clamped with a plurality of bolts and nuts 32 through the accesses 27 or 26 bolting the clamping members onto the extending rebar members 28 of each end to anchor abutting ends of the roadway barriers 10 together.

As more clearly seen also in FIGS. 3 and 4, the U-shaped supports 17 are held by a pair of bolts 18 passing therethrough and through the high density concrete core 12 while the supporting arm 16 can be seen as a pair of crossed arms which are interconnected and connected to the cover portion 21 of the anchors 14. In this manner, the central core of high density reinforced concrete is directly attached to the steel channel 17 and directly connected through the steel arms 16 to the anchor base portions 14 which are bolted or anchored to the roadway surface 13. The covers 21 are also are used in the forming of the molded barrier to protect the openings in the base 14 for the bolts 15. The roadway barrier is lightweight because of the lightweight concrete construction and can be aligned with their ends abutting and rapidly clamped together and then anchored to the roadway 13 to provide a continuous barrier of any length desired.

Referring back to the main roadway barrier portion 22, the concrete is formed using lightweight polymer materials which are resilient in nature and which can recycle used materials including used vehicle tires which have been cut up or chopped into pieces or chips or chopped up polystyrene which materials are otherwise difficult to recycle. The recycled rubber pieces or polystyrene pieces are incorporated into the cement and water mixture in place of rocks or gravel to form the lightweight concrete. However, this material cannot be mixed directly in the cement and water mixture because they tend to float to the surface and do not tend to bind to the cement when the cement cures.

The present materials are made by using the rubber chips which are may be rubber tires chopped into one inch or smaller diameter pieces and then placing those with ground broken glass of one quarter inch mesh in a tumbler and tumbling for a period to clean the rubber black carbon from the rubber members as well as to scratch or score the rubber. The treated rubber, including the glass if desired, is then added to a mixture of modified acrylic along with the conventional portland cement which is tumbled dried for a period before being placed in a cement mixer which then is tumbled with fiberglass particles which may be reclaimed fiberglass along with a portion of microsilica to which a dry mixture may be added sand, cement, and water to a flowable consistency for mixing of concrete. The mixing of the rubber pieces with the fiberglass and microsilica and an acrylic polymer as well as the prescoring and cleaning of the rubber components forms coated rubber pieces which then maintains their position in the concrete once the mixture is put together with the water which will then bind to the cement and the rubber will hold its place in the mixture without floating to the top. The mixture generally requires additional wet microsilica to be added along with a concrete curing agent such as DURASET made by W. R. Grace.

Alternatively, the present barrier portion 22 can be made with polystyrene beads or recycled polystyrene beads or broken up polystyrene pieces with or without the rubber in the prior mixture. The ground bottle glass or other broken glass used in the tumbling of the rubber may be left in the cement mixture to form a part of the final product. The polystyrene can be utilized using a coating of the recycled beads along with the microsilica mixture along with sand and cement of a dry mixture to which the water along with a surfactant agent is added during the mixing of the concrete prior to the forming in a mold shaped like the barrier 10. In the case of the polystyrene beads, they are typically coated with the microsilica mixture and can be used for recycling polystyrene which has been first broken up into pieces of predetermined size.

The process of making the present invention includes the steps of forming a mold shaped as shown in FIG. 1 with the energy absorbing roadway barrier 10 and the making of the anchor members 14 having the bases 14, the arms 16, the U-shaped core supports 17 shaped as shown in the drawings and then the making of a high density concrete core member having reinforcing rebar with at least one rebar member 28 protruding from the end which is set and supported in a series of barrier anchor and support members 14 and then forming a lightweight energy absorbing concrete thereover surrounding the central high density concrete core members 11 along with the supports 17. The base 14 covers 21 prevent the concrete from flowing and covering up the opening in the base 14 for attaching the base to a roadway and forming the barrier 10 as shown in the shape with the arcuate surfaces and flattened ridge top for directing roadway tires away from the barrier when impacting the barrier at an angle. The process also includes forming the clamps 31 and 32 which are bolted together to clamp the barrier sections 10 together. The process includes the mixing of a plurality of lightweight polymer members, such as rubber or polystyrene, which may be recycled rubber pieces or recycled polystyrene pieces, mixed with a fiberglass which may also be recycled fiberglass and microsilica, sand, portland cement and water in which the microsilica, some sand, portland cement, fiberglass can all be mixed dry and the mixing with the water and pouring the lightweight concrete mixture into a mold shaped to form the roadway barrier 10. In addition, the lightweight rubber members may be rubber tire pieces cut into chunks or chips and the mixture may include small amounts of rock and the tire members may be treated by tumbling with broken glass so that some glass can be also incorporated into the mixture. The mixture may also include an acrylic polymer, such as ROPLEX 76 by Rohm & Hass, and rock.

Accordingly, the process can include the step of tumbling rubber pieces with broken glass for a predetermined length of time, removing the rubber pieces which have been scored and mixing with acrylic, fiberglass, and microsilica and with a non-corrosive concrete curing agent or hardener, such as DURASET by W. R. Grace, and rock as desired to ultimately form a concrete barrier of great strength, lightweight, which is energy absorbing, and has some resiliency thereto and in which the rubber pieces of polystrene pieces are spread throughout the concrete and attached to the concrete rather than floating to the top or breaking loose inside the concrete from the concrete without any binding.

One specific mixture for one barrier might include five gallons of rubber chips 1" or smaller in diameter and two quarts of ground glass ¼" diameter dry tumbled for five minutes, then add one pound of acrylic and two pounds of cement and tumble for another five minutes. The mixture is then placed in a cement mixer and five gallons of ⅜" rock and 2 ½ gallons of reclaimed fiberglass and one gallon of microsilica added. The mixture is then dusted with a quart of sand. Ten gallons of sand and five gallons of Portland cement are then mixed dry with three gallons of wet microsilica and this mixture added to the cement mixture where water is added to make a pourable consistency. Two four ounce containers of DURASET or other concrete curing agent is then added to the mixture.

It should be clear at this time that an energy absorbing roadway barrier for dissipating kinetic energy upon impact by a moving vehicle has been disclosed and the process of making an energy absorbing roadway barrier for dissipating kinetic energy upon impact by a moving vehicle have both been illustrated in which lightweight materials, such as chopped up rubber tire pieces and chopped up polystyrene, are used to recycle these materials into the road barriers. However, the present invention is not to be construed as limited to the forms shown which are to be considered illustrative rather than restrictive.

I claim:

1. An energy absorbing roadway barrier for dissipating kinetic energy upon impact by a moving vehicle comprising:

an elongated core of reinforced high density concrete;

a plurality of elongated core supports and barrier anchor members attached to said elongated core;

an elongated barrier portion formed around said elongated core and around each elongated core support and anchor member, said barrier portion being shaped to form a roadway barrier member and being formed of a lightweight concrete having lightweight polymer pieces formed in a cement and water mixture; and an interlock portion formed on the end of each roadway barrier member for attaching an adjacent roadway barrier member whereby an energy absorbing barrier member will dissipate kinetic energy upon impact by a vehicle.

2. An energy absorbing roadway barrier for dissipating kinetic energy upon impact by a moving vehicle in accordance with claim 1 in which said polymer pieces are pieces of rubber.

3. An energy absorbing roadway barrier for dissipating kinetic energy upon impact by a moving vehicle in accordance with claim 1 in which said polymer pieces are pieces of polystyrene.

4. An energy absorbing roadway barrier for dissipating kinetic energy upon impact by a moving vehicle in accordance with claim 1 in which said roadway barrier member lightweight concrete includes fiberglass therein.

5. An energy absorbing roadway barrier for dissipating kinetic energy upon impact by a moving vehicle in accordance with claim 4 in which said roadway barrier member lightweight concrete includes microsilica therein.

6. An energy absorbing roadway barrier for dissipating kinetic energy upon impact by a moving vehicle in accordance with claim 5 in which said roadway barrier member lightweight concrete includes acrylic therein.

7. An energy absorbing roadway barrier for dissipating kinetic energy upon impact by a moving vehicle in accordance with claim 6 in which said roadway barrier member lightweight concrete includes rock therein.

8. An energy absorbing roadway barrier for dissipating kinetic energy upon impact by a moving vehicle in accordance with claim 1 in which said elongated core has a square cross-section having a reinforcing rebar member protruding from at least one end thereof.

9. An energy absorbing roadway barrier for dissipating kinetic energy upon impact by a moving vehicle in accordance with claim 8 in which each of said plurality of core supports are anchored to said elongated core and has arms extending to at least one base member and said base member having a plurality of openings therein for attaching to a road.

* * * * *